United States Patent [19]

Ricketts et al.

[11] 4,449,753

[45] May 22, 1984

[54] METHOD FOR BULKING FULL A RETORT

[75] Inventors: Thomas E. Ricketts, Grand Junction, Colo.; Allan Sass, Los Angeles, Calif.

[73] Assignee: Occidental Oil Shale, Inc., Grand Junction, Colo.

[21] Appl. No.: 383,508

[22] Filed: Jun. 1, 1982

[51] Int. Cl.[3] ..... E21B 43/247; E21C 41/10

[52] U.S. Cl. ..... 299/2; 166/251; 166/259; 299/13

[58] Field of Search ..... 299/2, 13; 166/259, 166/299, 251; 102/311, 312

[56] References Cited

U.S. PATENT DOCUMENTS

| | | | |
|---|---|---|---|
| 3,001,776 | 9/1961 | Van Poollen . | |
| 3,316,020 | 4/1967 | Bergstrom . | |
| 3,434,757 | 3/1969 | Prats . | |
| 3,533,469 | 10/1970 | Parker . | |
| 3,611,933 | 10/1971 | Lanning . | |
| 3,630,283 | 12/1971 | Knutson et al. . | |
| 3,661,423 | 5/1972 | Garrett . | |
| 3,677,342 | 7/1972 | Silverman . | |
| 3,980,339 | 9/1976 | Heald et al. . | |
| 4,027,917 | 6/1977 | Bartel et al. | 299/2 |
| 4,043,597 | 8/1977 | French | 299/2 |
| 4,043,598 | 8/1977 | French et al. | 166/259 X |
| 4,349,227 | 9/1982 | Langford | 299/2 |
| 4,360,233 | 11/1982 | Ricketts | 299/2 |

*Primary Examiner*—George A. Suchfield
*Attorney, Agent, or Firm*—Christie, Parker & Hale

[57] ABSTRACT

A method for forming an in situ oil shale retort in a subterranean formation containing oil shale is provided. The in situ oil shale retort has top, bottom, and generally vertically extending side boundaries of unfragmented formation and contains a body of expanded oil shale formation that completely fills the retort to its top boundary. The retort is bulked full by explosively expanding a layer above a fragmented permeable mass of formation particles forming part of the body of expanded formation in the retort. The layer is expanded with an available void fraction of no more than about ten percent.

57 Claims, 3 Drawing Figures

METHOD FOR BULKING FULL A RETORT

This invention relates to an in situ oil shale retort that is completely bulked full of explosively expanded oil shale and to a method for forming the bulked full retort.

BACKGROUND OF THE INVENTION

The presence of large deposits of oil shale in the semi-arid, high plateau region of the western United States has given rise to extensive efforts to develop methods for recovering shale oil from kerogen in the oil shale deposits. The term "oil shale" as used in the industry is, in fact, a misnomer; it is neither shale nor does it contain oil. It is a sedimentary formation comprising marlstone deposit containing an organic polymer called "kerogen" which, upon heating, decomposes to produce liquid and gaseous products, including hydrocarbon products. It is the formation containing kerogen that is called "oil shale" herein; the carbonaceous liquid product is called "shale oil".

A number of methods have been proposed for processing oil shale which involve either mining the kerogen-bearing shale and processing the shale on the surface or processing the shale in situ. The latter approach is preferable from the standpoint of environmental impact since the spent shale remains in place, reducing the chance of surface contamination and the requirement for disposal of solid wastes. According to both of these approaches, oil shale is retorted by heating the oil shale to a sufficient temperature to decompose kerogen and produce shale oil which drains from the rock. The retorted shale, after kerogen decomposition, contains substantial amounts of residual carbonaceous material which can be burned to supply heat for retorting.

One technique for recovering shale oil includes forming an in situ oil shale retort in a subterranean formation containing oil shale. At least a portion of the formation within the boundaries of the in situ oil shale retort is explosively expanded toward one or more voids excavated in the subterranean formation to form a fragmented permeable mass of formation particles containing oil shale in the retort. The fragmented mass of particles is ignited near the top of the retort to establish a combustion zone. An oxygen-supplying gas is introduced into the top of the retort to sustain the combustion zone and cause it to move downwardly through the fragmented mass. As burning proceeds, the heat of combustion is transferred to the fragmented mass of particles below the combustion zone to release shale oil and gaseous products therefrom in a retorting zone. The retorting zone moves from the top to the bottom of the retort ahead of the combustion zone and the resulting shale oil and gaseous products pass to the bottom of the retort for collection and removal. Recovery of liquid and gaseous products from oil shale deposits is described in greater detail in U.S. Pat. No. 3,661,423 to Donald E. Garrett.

As used herein, the term "retorting zone" refers to that portion of the retort where kerogen in oil shale is being decomposed to liquid and gaseous products, leaving residual carbonaceous material in the retorted oil shale. The term "combustion zone" refers to a portion of the retort where the greater part of the oxygen in the retort inlet mixture that reacts with the residual carbonaceous material in the retorted oil shale is consumed.

It has been found desirable in some embodiments to have an intact subterranean base of operation above the fragmented permeable mass of formation particles in an in situ oil shale retort. Such a base of operation facilitates the drilling of blastholes into underlying formation for forming the fragmented mass in the retort and facilitates ignition over the entire top portion of the fragmented mass. Additionally, having a base of operation above the fragmented mass permits control of introduction of oxygen-supplying gas into the retort, provides a location for testing properties of the fragmented mass, and provides a location for evaluation and controlling performance of the retort during operation.

The base of operation is separated from the retort by a layer of unfragmented formation extending between the top boundary of the retort and the floor of such a base of operation. The layer of unfragmented formation is termed a "sill pillar" which acts as a barrier between the in situ oil shale retort and the base of operation during retorting operations. It is, therefore, important that the sill pillar remain structurally sound, both for supporting the base of operation and for preventing entry of heat and gases into the base of operation during the retorting process.

Techniques for forming an in situ oil shale retort containing a fragmented permeable mass of formation particles and having a sill pillar of unfragmented formation between the top of the fragmented mass and an overlying base of operation are described in U.S. Pat. No. 4,118,071 by Ned M. Hutchins and in U.S. Pat. No. 4,192,554 by Thomas E. Ricketts. U.S. Pat. Nos. 4,118,071 and 4,192,554 are incorporated herein by this reference.

In retorts where no base of operation is provided, the formation overlying the fragmented permeable mass of formation particles extends all the way to the ground surface. In such an embodiment, blastholes are drilled through the overlying formation and ignition of the fragmented mass of particles is accomplished from the ground surface.

Examples of other techniques used for forming in situ oil shale retorts are described in U.S. Pat. No. 4,043,595 by French; U.S. Pat. No. 4,043,596 by Ridley; U.S. Pat. No. 4,043,597 by French; and U.S. Pat. No. 4,043,598 by French et al, each of which is incorporated herein by this reference.

When unfragmented formation is explosively fragmented and expanded, e.g., toward a void space when forming a retort, it increases in bulk due to void spaces in interstices between the particles. The maximum expansion of an oil shale formation into an unlimited void results in a fragmented mass of oil shale particles having an average void fraction of about 35 percent; that is, about 35 percent of the total volume occupied by the fragmented mass is void space between the particles. The volume occupied by the fragmented mass is about 55 percent larger than the volume occupied by the original unfragmented formation after such unlimited or free expansion.

A "limited void" is one where the void space available for explosive expansion is less than needed for free bulking of the formation expanded toward that void. Thus, if a void has an excavated volume less than about 35 percent of the total of the volume of the void plus the volume occupied by formation explosively expanded, it is necessarily a limited void. It has been found that factors in addition to total available void can make a void "limited" even though the total available void may appear sufficient for free bulking.

When oil shale is explosively expanded toward a limited void, the void fraction of the fragmented mass of particles formed can be no more than permitted by the available void space of the void and, in some instances, has been found to be less. It is believed that the void fraction of the fragmented mass can be less than the available void space provided by such a limited void because when oil shale is explosively expanded toward the void, gases from the detonation may not have full opportunity to act on the oil shale particles before such particles reach obstructions, such as adjacent walls, a face opposite to the expanding formation, or oil shale expanding from the opposite sides of the void.

Thus, when formation is expanded toward one or more limited voids for forming an in situ oil shale retort, a void space can remain in the completed retort between the surface of the fragmented mass of particles formed and overlying unfragmented formation, i.e., the retort top boundary.

When a void space is between overlying unfragmented formation and the fragmented mass in a retort, heating of the overlying formation during ignition and/or retorting operations can result in spalling or sloughing of formation into the retort. This can prolong the ignition process and, in some instances, can make ignition impossible. Additionally, sloughed formation can be heated sufficiently to consume at least a portion of the oxygen being supplied to the retort during retorting operations. This can upset the desired material balance in the retort and deleteriously affect the amount of products recovered.

When the retort has an overlying sill pillar and a void space exists between the top of the fragmented mass in the retort and the bottom of the sill pillar, i.e., the top boundary of the retort, sloughing of formation from the bottom of the sill pillar can weaken it. If the sloughing is sufficient, the sill pillar can lose its structural integrity, thus rendering the base of operation unsafe for occupancy.

It can, therefore, be important to provide support for unfragmented formation which comprises the top boundary of an in situ retort to reduce or eliminate sloughing of formation from the top boundary into the retort.

SUMMARY OF THE INVENTION

There is, therefore, provided in practice of this invention an in situ oil shale retort that comprises a top boundary of unfragmented formation that is supported to inhibit sloughing. The in situ retort is in a subterranean formation containing oil shale and comprises generally horizontally extending top and bottom boundaries, and generally vertically extending side boundaries of unfragmented formation. A body of explosively expanded oil shale formation is contained within the retort boundaries. The body of expanded formation comprises a first portion comprising a fragmented permeable mass of formation particles extending from the bottom boundary of the retort to an elevation below the top boundary. A remaining portion of the body of explosively expanded oil shale formation comprises a layer of expanded formation that extends between the top of the first portion and the top boundary of the retort. The layer is provided to support the top boundary to thereby inhibit formation from sloughing from the top boundary into the retort.

A preferred embodiment of the in situ oil shale retort of this invention is formed by forming the first or lower portion of the body of expanded oil shale formation comprising a fragmented permeable mass of formation particles. Thereafter, a layer of unfragmented formation is explosively expanded downwardly toward the lower portion of the body of expanded formation for forming the remaining portion of the body of expanded formation. The layer of unfragmented formation has a volume sufficient to provide that the available void fraction for expansion of the layer is no more than about ten percent so that the remaining portion of the body of expanded formation completely fills the retort to its top boundary.

DRAWINGS

These and other features, aspects, and advantages of the present invention will become more apparent when considered with respect to the following description, appended claims, and accompanying drawings wherein:

DETAILED DESCRIPTION

Figure 1:
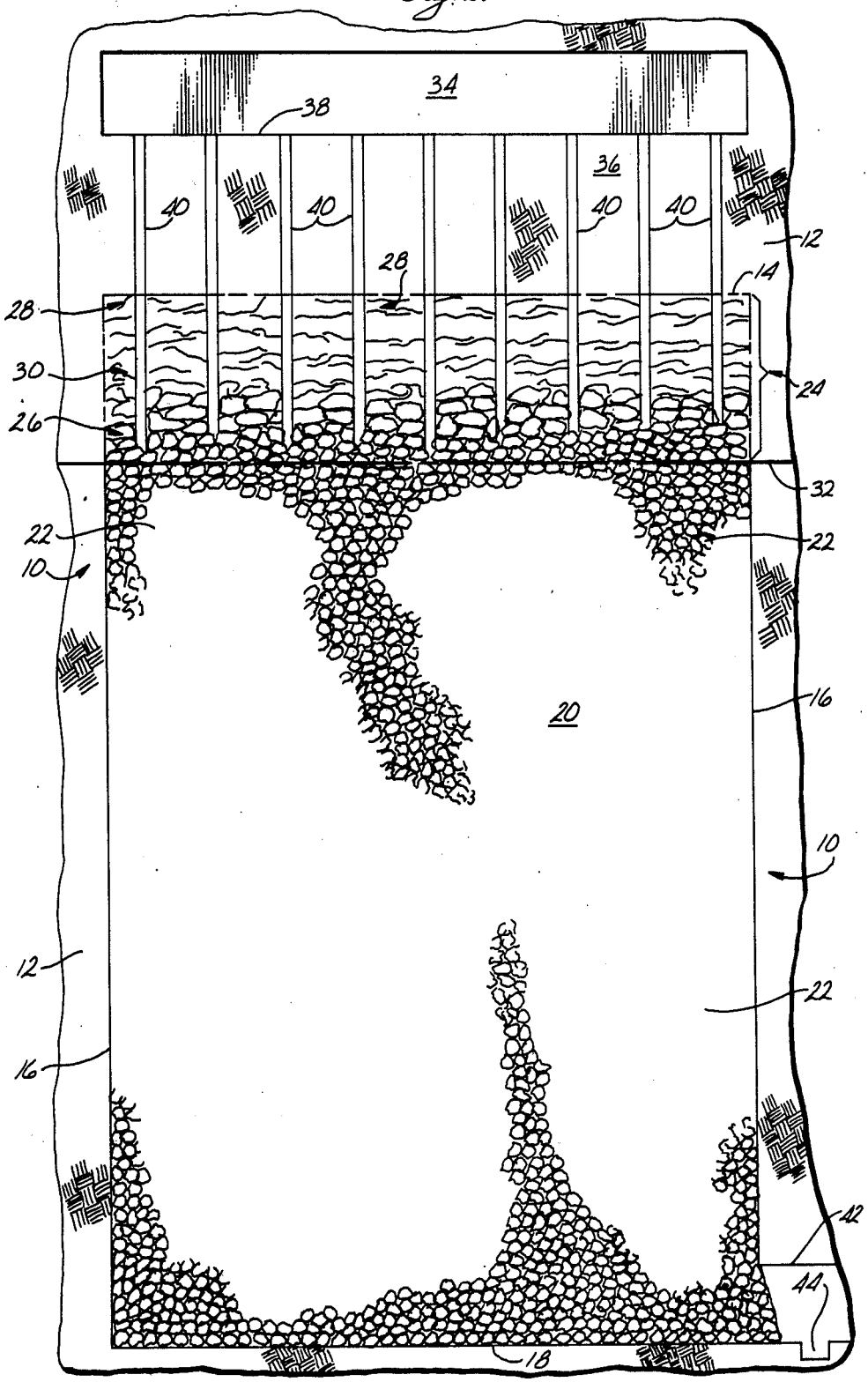
FIG. 1 is a fragmentary, semi-schematic, vertical, cross-sectional view of one embodiment of an in situ oil shale retort provided in accordance with practice of principles of this invention.

Referring to FIG. 1, there is shown a fragmentary, semi-schematic, vertical, cross-sectional view of one embodiment of an in situ oil shale retort 10 prepared in accordance with practice of principles of this invention. In an exemplary embodiment, the in situ retort 10 can be square or rectangular in horizontal cross-section, however, retorts having other shapes can be formed if desired.

The retort is in a retort site in a subterranean formation 12 containing oil shale and has a generally horizontal top boundary 14, generally vertically extending side boundaries 16, and a bottom boundary 18 of unfragmented formation.

A body 20 of explosively expanded oil shale formation is contained within the retort and completely fills the retort to its top boundary 14. Preferably, a major portion of the body 20 of expanded formation comprises a fragmented permeable mass 22 of oil shale particles that extends from the retort bottom boundary 18 to an elevation spaced apart vertically below the top boundary 14. Within the fragmented permeable mass, the void fraction is reasonably uniformly distributed. That is, the void fraction in any significant region of the fragmented mass is not greatly different from the average void fraction in the fragmented mass. For example, such a fragmented mass can be considered to have a reasonably uniform void fraction distribution even though such significant regions of the fragmented mass vary in void fraction as much as about ±50% from the average void fraction in the mass. The remaining portion of the body 20 of expanded formation comprises a generally horizontal layer 24 of expanded formation that extends between the top of the first portion of the body of expanded formation and the top boundary 4 of the retort. Thus, the layer 24 provides support for the overlying unfragmented formation of the retort top boundary 14 to inhibit sloughing of formation from the top boundary into the retort.

Although the fragmented mass of formation particles 22 (the first portion of the body of expanded formation) and the horizontal layer 24 (the remaining portion of the body of expanded formation) are distinct from each other, the exact locus where the fragmented mass 22 ends and the layer 24 begins is difficult to define once they are formed. For example, although it is preferable that the fragmented mass has a reasonably uniformly distributed void fraction throughout, it is preferable that the layer 24 have a void fraction or permeability that varies from relatively higher at its bottom to relatively lower at its top. Thus, a generally horizontally extending zone 26 at the bottom of the layer 24 can comprise formation fragmented to about the same degree as the formation making up the fragmented mass 22. On the other hand, a generally horizontally extending zone 28 at the top of the layer 24 preferably is expanded only slightly, if at all. A generally horizontally extending center zone 30 of the layer 24 comprises fractured oil shale formation and extends between the top and bottom zones of the layer. These zones are not clearly divided and blend gradually together. The average void fraction in the explosively expanded layer 24 equals the available void fraction as explained hereinafter.

For purposes of exposition herein, the top of the fragmented mass 22 is shown extending horizontally across the retort in an imaginary plane 32 and, thus, all the expanded formation below the imaginary plane 32 comprises the fragmented mass 22. All of the expanded formation above the plane 32 comprises the layer 24 of expanded formation. The intersection 32 between the lower fragmented mass and the overlying layer of expanded formation may not be a plane. For example, in the event the top of the fragmented mass has a central mound after explosive expansion, the intersection will be convex upward. An advantage of the technique described herein is the ability to accommodate such a non-planar top surface of the fragmented mass and still bulk the retort full of explosively expanded formation.

As mentioned above, the top zone 28 of the layer 24 is preferably expanded only slightly and, thus, it comprises essentially intact formation adjacent the top boundary 14 of the retort. Having a zone 28 of essentially intact formation at the retort top boundary enhances the ability of the layer to support the overlying unfragmented formation of the top boundary.

Also, as mentioned above, the bottom zone 26 of the layer comprises fragmented oil shale particles. Having a bottom zone comprising fragmented oil shale can increase the amount of formation that can be retorted and, thus, enhance the yield of liquid and gaseous products from the retort.

In effect, the upper layer 24 provides a gradual transition between the fragmented permeable mass with relatively high void fraction constituting most of the body of expanded formation in the retort and overlying unfragmented formation with essentially zero void fraction. Stated otherwise, the layer provides a zone of gradually decreasing permeability between the fragmented mass and the top boundary of the retort. Because of such gradual transition, the locus of the "top boundary" may not be distinctly defined. This has little significance since, as pointed out hereinafter, gas inlet conduits are drilled through at least a portion of the transition layer for lowering pressure drop and the outlets of the conduits define an effective top boundary for retorting.

An open base of operation 34 is in the subterranean formation and extends across the top of the retort. A sill pillar 36 of unfragmented formation is between the retort top boundary 14 and the floor 38 of the base of operation. The sill pillar acts as a barrier between the in situ oil shale retort and the base of operation during retorting operations. It is important that the sill pillar remain structurally sound, both for supporting the base of operation and for preventing entry of heat and gases into the base of operation during the retorting process.

Whether a base of operation is provided for operating the retort, or operations are conducted from the ground surface, the expanded formation layer 24 provided in accordance with this invention supports unfragmented formation overlying the retort and, thus, prevents sloughing of formation into the retort. When a sill pillar is used, the layer 24 maintains the structural integrity of the sill pillar.

One or more conduits 40 extend through the sill pillar 36 and through at least a portion of the layer 24 of explosively expanded formation. The conduits 40 can be used for igniting the retort and for introduction of a retort inlet mixture, such as air or other oxygen-supplying gas, to support combustion.

A tunnel or drift 42 is provided at the bottom of the retort as a retort outlet for withdrawal of liquids and off-gas. Off-gas includes the products of combustion of carbonaceous material in the oil shale, any gaseous non-reactive portion of the retort inlet mixture, and gaseous products of retorting. A sump 44 is provided as a retort outlet for collecting liquid products, including shale oil and water. If desired, the bottom of the retort can be closed, i.e., the drift 42 blocked by a bulkhead, and products removed through conduits in the tunnel. Alternatively, liquid and gaseous products can be withdrawn downwardly through the bottom boundary to an underlying drift system.

Figure 2:
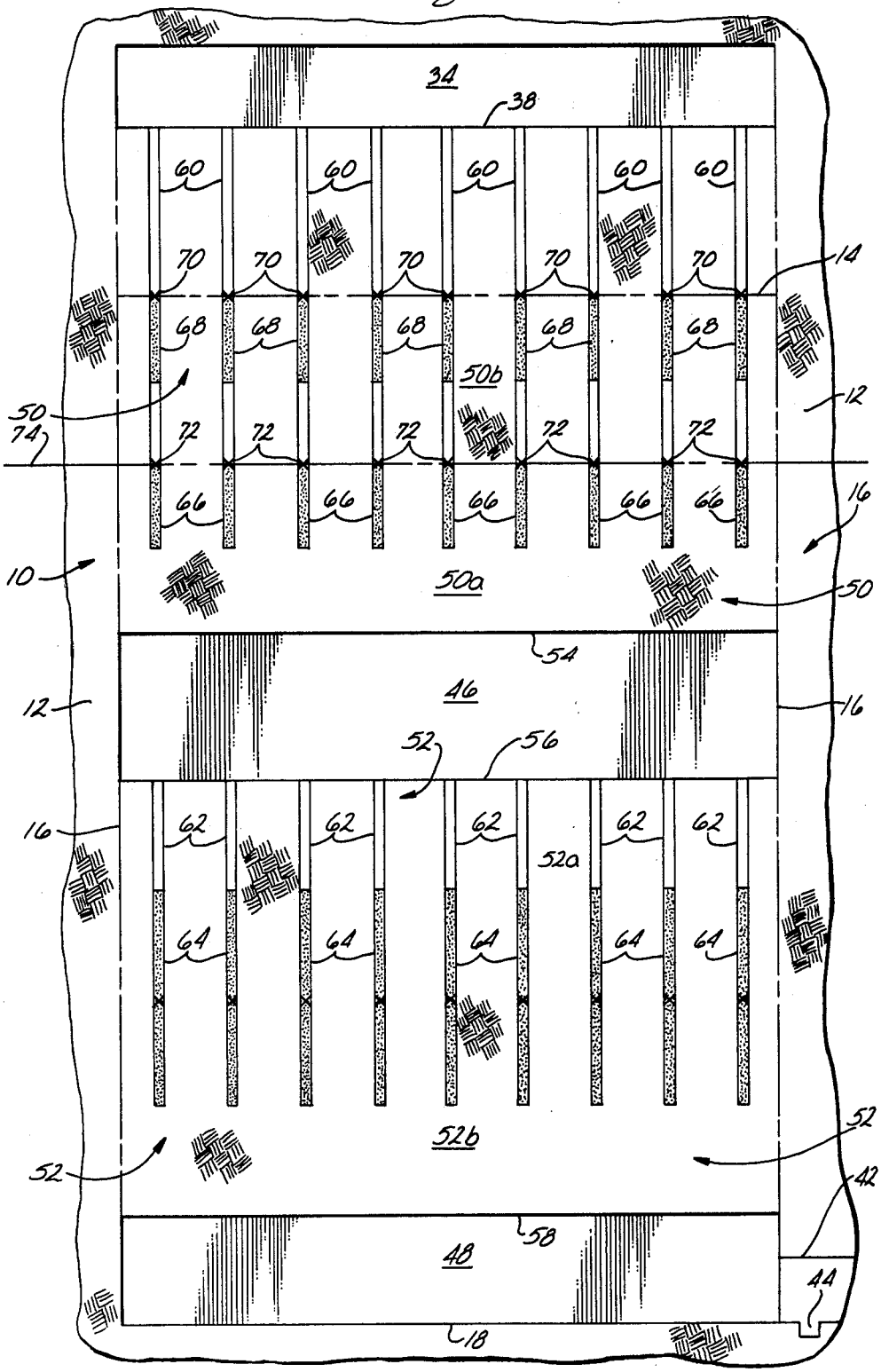
FIG. 2 is a fragmentary, semi-schematic, vertical, cross-sectional view of the in situ oil shale retort of FIG. 1 at one stage in its preparation.
Figure 3:
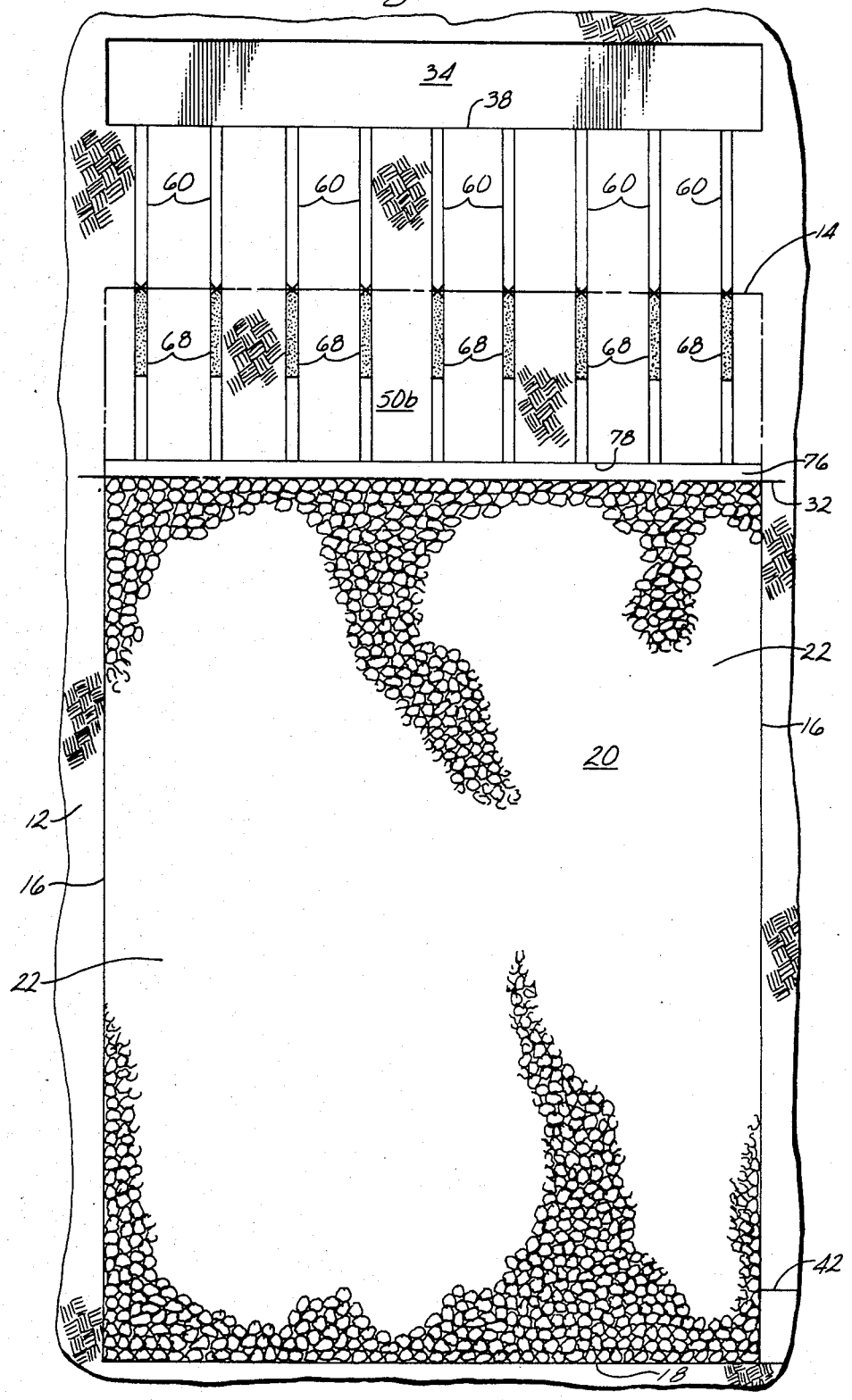
FIG. 3 is a fragmentary, semi-schematic, vertical, cross-sectional view of the in situ oil shale retort of FIG. 1 at another stage in its preparation.

An exemplary embodiment of a method useful for forming the in situ oil shale retort 10 can be understood by referring to FIGS. 2 and 3, which are fragmentary, semi-schematic, vertical, cross-sectional views of the retort 10 at various stages during its preparation according to practice of this invention.

A portion of the subterranean formation 12 within the boundaries of the retort 10 is excavated to form at least one generally horizontal void extending between the side boundaries of the retort. The remaining portion of unfragmented formation within the retort boundaries adjacent such a void or voids is explosively expanded toward the void(s) to form the body of expanded formation in the retort.

In the illustrated embodiment, formation is excavated to form two voids; a generally horizontal upper void 46 and a generally horizontal lower void 48. Both the upper and lower voids 46 and 48 extend between the retort side boundaries 16 and are located one above the other. The upper and lower voids together preferably occupy more than about 15 percent of the total volume of the retort 10 being formed. Having the voids occupy more than about 15 percent of the volume of the retort is preferred so that the fragmented permeable mass 22 has an average void fraction that is greater than about 15%. When the average void fraction is less than about 15%, the pressure drop through the retort can be undesirably high.

The unfragmented formation remaining within the retort boundaries, after the upper and lower voids 46 and 48 are excavated, comprises an upper zone 50 of unfragmented formation adjacent and above the upper void 46 and a lower zone 52 of unfragmented formation between the voids. The upper zone 50 has a substantially horizontal free face 54 which extends over the void 46 and, thus, comprises the roof of the void. The lower zone has a substantially horizontal upper free face 56 adjacent and below the upper void and a substantially horizontal lower free face 58 adjacent and above the lower void. The floor of the lower void is the bottom boundary 18 of the retort.

To form the body 20 of explosively expanded oil shale formation, the upper and lower zones of unfragmented formation are loaded with explosive charges and the charges are detonated to explosively expand the zones toward the voids. The upper zone 50 is expanded downwardly toward the upper void 46, while the lower zone 52 is expanded both upwardly toward the upper void 46 and downwardly toward the lower void 48.

The zones of unfragmented formation are prepared for explosive expansion by drilling blastholes into the zones and loading the blastholes with explosive charges. For example, an array of horizontally spaced apart, substantially vertical blastholes 60 is drilled into the upper zone 50 of unfragmented formation from the base of operation 34. As mentioned above, when no base of operation is provided, the blastholes 60 can be drilled from the ground surface. An array of horizontally spaced apart substantially vertical blastholes 62 is drilled into the lower zone 52 of unfragmented formation from the upper void 46. The blastholes are shown out of proportion in the figures for clarity of illustration, i.e., the blasthole diameter is actually much smaller in comparison to the size of the retort being formed than is shown in the figures.

An array of blastholes can comprise any number of rows of blastholes and any number of blastholes in a row. Similarly, the blastholes can be arranged in any configuration; for example, triangular, rectangular, pentangular, and the like.

In an exemplary embodiment, the array of blastholes 60 comprises nine rows of blastholes with nine blastholes in each row. The array 60 is a square array having equal spacing distance between adjacent blastholes, i.e., the sides of each rectangle defined by each four adjacent blastholes are about equal.

The pattern of the array of blastholes drilled into the lower zone of unfragmented formation can be substantially identical to the pattern of the array of blastholes 60 in the upper zone or can differ, if desired.

As is mentioned above, the blastholes 62 in the lower zone 52 are loaded with explosive for explosively expanding about the top half of the lower zone toward the upper void 46 and about the bottom half of the lower zone toward the lower void 48. The blastholes 62 are preferably drilled about three-fourths of the distance through the lower zone from the upper void. Explosive is placed into each of the blastholes 62 until each blasthole is about one-third full of explosive. A detonator designated by an "x" is placed into each blasthole for providing detonators at about the center of height of the lower zone of unfragmented formation. Additional explosive is then placed into each of the blastholes 62, preferably until each blasthole is filled about two-thirds full, thereby providing explosive charges 64. The upper portion of each blasthole is stemmed with inert material. The charges 64 are generally vertical, horizontally spaced apart columnar explosive charges with all of the charges 64 preferably at the same elevation in the retort at about the center of the lower zone. Thus, the charges 64 form a horizontally extending array with each charge extending about half the distance toward the free faces 56 and 58 from the center of the lower zone.

The blastholes 60 in the upper zone of unfragmented formation are loaded with explosive for forming at least one array of generally vertical, horizontally spaced apart columnar explosive charges in the upper zone. In the illustrated embodiment, the upper zone is expanded in two layers or decks and, thus, two horizontal arrays of explosive charges are provided. Explosive is loaded into the bottom of each blasthole 60 and a detonator designated by an "x" is placed at the top of the explosive in each blasthole to form an explosive charge 66 in each blasthole. The charges 66 are generally vertical, horizontally spaced apart columnar explosive charges, preferably in a generally horizontal array. The array of charges 66 is adjacent the horizontally extending free face 54 of the upper zone and is provided for expanding a generally horizontal bottom layer or portion **50*a* of the upper zone toward the void 46 to provide a portion of the fragmented mass 22**.

Stemming is provided above each charge 66 in the array and additional explosive is placed into each blasthole above the stemming. A detonator is placed at the top of the explosive above the stemming in each blasthole 60 for providing a second generally horizontally extending upper array of generally vertical, columnar explosive charges 68 in the upper zone.

Additional details of deck loading explosive charges are described in U.S. Pat. No. 4,146,272 to Gordon B. French, which is incorporated herein by this reference.

The upper array of charges 68 is provided for expanding a generally horizontal top layer or portion **50*b* of the upper zone downwardly toward the void 46 to provide the layer 24 of expanded formation described above and shown in FIG. 1. Thus, the volume of the upper layer 50*b* is selected so that when the layer 50*b*** is expanded, it fills the retort to the retort top boundary.

The volume of the layer **50*b* is defined by the location of the first and second arrays 66 and 68 of explosive charges in the blastholes 60. The upper array of charges 68 is remote from the horizontally extending free face 54 with each such charge 68 having a distal end 70 in a horizontal plane defining the retort top boundary 14. Said another way, the distal end of each such upper charge 68 is contiguous with the retort top boundary. Preferably, the upper charges 68 extend about halfway from the top boundary 14 to the adjacent end 72 of the lower charges 66. The upper charges 68 can have other lengths, if desired. As mentioned above, the distal ends of the upper charges define the retort top boundary. A generally horizontal plane 74 extending through the ends 72 of the lower charges 66 remote from the free face 54 defines the bottom of the layer 50*b*. Thus, the layer 50*b* extends between the horizontal plane defining the top boundary 14 and a horizontal plane 74 extending through the ends 72 of the lower charges 66**.

If desired, the detonators "x" can be placed at locations in the explosive charges other than the locations described above and shown in the drawings.

In an exemplary embodiment, the array of explosive charges has an equivalent point charge scaled depth of burial from about 6 to about 12 mm/cal$^{\frac{1}{3}}$. The scaled depth of burial (SDOB) is a useful relation for comparing blasting patterns having differing burden distance, explosive energy, and array geometries. Scaled depth of burial, as it applies to cratering or explosive expansion toward a free face, is described in a paper by Bruce B. Redpath, entitled "Application of Cratering Characteristics to Conventional Blast Design", a copy of which accompanies this application and which is incorporated herein by reference. Although the relations set forth are derived for an essentially infinite free face, the principles have been found applicable for explosive expansion toward a limited void.

The point charge scaled depth of burial (SDOB) of an explosive charge can be expressed in units of distance over weight of explosive to the one-third power or, preferably, distance over energy of explosive to the one-third power. The SDOB of a point charge, for example, is given by SDOB equals $DOB/W^{\frac{1}{3}}$ where DOB is the actual depth of burial or burden of the charge from the free face and W is the weight of the charge. It is often preferable to state the SDOB in terms of energy of explosive rather than weight, hence the units $mm/cal^{\frac{1}{3}}$. In the Redpath paper, SDOB is stated in terms of $ft/lb^{\frac{1}{3}}$ and this can be approximately converted to $mm/cal^{\frac{1}{3}}$ by multiplying by about four for a number of common types of explosive.

An equivalent point charge scaled depth of burial can be defined for an array of charges. Relationships between the point charge scaled depth of burial of individual charges in an array and the equivalent point charge scaled depth of burial of the array are described in U.S. Pat. No. 4,245,865 issued to Thomas E. Ricketts on Jan. 20, 1981. U.S. Pat. No. 4,245,865 is incorporated herein by this reference.

To form the first portion of the body 20 of expanded oil shale formation in the retort, the lower array of explosive charges 66 in the upper zone and the array of explosive charges 64 in the lower zone are preferably detonated in a single round for explosively expanding the zones of unfragmented formation toward the voids. Preferably, the upper array of charges 68 in the top layer **50*b* of the upper zone is detonated in the same single round with the previously detonated charges to form the remaining portion of the body of expanded formation. Alternatively, if desired, the upper charges 68 can be detonated in a separate round. In any event, whether the upper charges 68 are detonated in the same single round as the other charges 64 and 66 or in a separate round, the upper charges 68** are preferably detonated last.

A "single round" as used herein means detonation of a number of separate explosive charges, either simultaneously or with only a short time delay between separate detonations. A time delay between detonations in a sequence is short when formation explosively expanded by detonation of one explosive charge has either not yet moved or is still in motion at the time of detonation of a subsequent explosive charge.

Detonation of the charges 64 and 66 expands the bottom portion **50*a* of the upper zone and about the top half 52*a* of the lower zone toward the void 46, and the bottom half 52*b* of the lower zone toward the void 48** for forming a bottom portion of the body of expanded oil shale formation.

As mentioned above, it was found that when unfragmented oil shale formation is explosively expanded toward a generally horizontal void of limited volume, such a limited void may not be completely filled with the resulting expanded formation. It has also been determined by extrapolation of experimental data that when oil shale formation is expanded toward a limited void and the "available void fraction", i.e., the volume of the void divided by the volume of the void plus the volume of formation being expanded toward that void, is less than about ten percent, the total available void volume will be filled.

In the illustrated embodiment, the total volume of the voids 46 and 48 is between about 15 percent and about 45 percent of the total volume within the retort boundaries. Thus, even though the voids 46 and 48 can act as limited voids, the total volume that they provide is not completely filled with formation expanded toward them because the available void fraction is greater than about 10 percent.

Referring specifically to FIG. 3, the fragmented permeable mass 22, i.e., the bottom portion of the body of expanded oil shale formation formed by the explosive expansion of the lower zone 52 and the bottom portion **50*a* of the upper zone is shown after the expanded formation has come to rest. A void space 76 is between the top surface 32 of the fragmented mass 22 and a generally horizontal free face 78 newly formed by detonation of the charges 66**.

After the explosive charges 64 in the lower zone and the charges 66 in the bottom portion **50*a* of the upper zone have been detonated for forming the first portion of the body of expanded oil shale formation, the upper explosive charges 68 are detonated for expanding the top layer 50*b* of the upper zone downwardly toward the free face 78 to form the layer 24** of explosively expanded formation adjacent the top boundary of the retort.

The desired volume of the upper layer **50*b* is determined by the volume of void space available into which the upper layer 50*b* can expand. The volume of available void space can be calculated prior to the start of the detonation sequence from known bulking factors for oil shale explosively expanded by various techniques. The volume of void space available is considered to be approximately the same whether the upper layer is expanded in a separate round after the fragmented mass 22 has come to rest or is expanded in the same single round while the fragmented mass 22** being formed is still in motion.

As mentioned above, when the void fraction available for expansion of the upper layer **50*b* is less than about ten percent, the expanded layer will completely fill the available void space and will have a configuration similar to the layer 24**. The explosively expanded layer can have a relatively higher void fraction adjacent the fragmented mass below it in the retort and a relatively low void fraction near the overlying unfragmented formation. The average void fraction in the layer when the retort is bulked full corresponds to the available void fraction; for example, no more than about ten percent. It can be preferred to use an available void fraction of less than about five percent to assure the filling of the available void space.

When the upper array of explosive charges 68 is not detonated in the same single round with the lower arrays of charges 64 and 66, the volume of the void space 76 can be measured after the fragmented mass 22 has been formed. The volume of the top layer **50*b* required to completely bulk full the retort, i.e., to provide an available void fraction of less than ten percent, can be calculated based on the measured void space volume. This calculation can be made before the second array of explosive charges 68 is formed in the upper zone so that the charges 68 can be located in the formation based on the calculation to define a layer 50*b*** of desired volume.

Although, in the illustrated embodiment, two voids (the upper void 46 and lower void 48) are excavated in the formation, if desired, only one void can be used and a zone of overlying unfragmented formation can be expanded downwardly toward the void in layers or lifts for forming the body of expanded oil shale formation in the retort.

Alternatively, when one void is used, formation can be expanded both upwardly from the zone of unfragmented formation below the void, and downwardly from the zone of unfragmented formation above the void. When formation is expanded both upwardly and downwardly toward a single void, expansion of the last layer of formation from above is at a time later than expansion of formation from below.

Also, if desired, the retort 10 can be formed in accordance with this invention by expanding formation toward more than two voids excavated within the retort boundaries.

An additional technique for forming a fragmented permeable mass of formation particles in an in situ oil shale retort is described in U.S. Pat. No. 4,192,554. In such an embodiment, an upper level void has a roof at the top boundary of the retort. When explosively expanded, the fragmented mass may leave a void space beneath the top boundary, i.e., the retort is not bulked full. Such a retort can be bulked full in practice of this invention by explosively expanding a layer of formation from above the roof of the void downwardly toward the fragmented mass in the retort. The available void fraction for expansion of that layer is sufficiently small that a gradual transition in void fraction is provided between the underlying fragmented mass and the overlying unfragmented formation.

Although, in the illustrated embodiment, the upper void 46 and lower void 48 are substantially completely devoid of unfragmented formation, unfragmented formation can be left within such voids for forming pillars between the floor and roof for temporary support of overlying formation prior to explosive expansion. In voids having pillars of unfragmented formation, the pillars are explosively expanded first and, thereafter, unfragmented formation from above and/or below the void is explosively expanded into the void to form the body of expanded formation in the retort.

After the body 20 of expanded oil shale formation is formed in the retort, final preparation steps for producing liquid and gaseous products in the retort are carried out. Referring again to FIG. 1, the final preparation steps include providing the conduits 40 which communicate from the base of operation into the body of expanded oil shale in the retort. The conduits 40 can be the blastholes 60 used for explosive expansion of the upper zone of unfragmented formation or, alternatively, can be drilled through the formation after the body 20 of expanded formation is formed. If the blastholes 60 are used, they may have to be redrilled to clear them of stemming or formation that has expanded into them during the detonation sequence.

The layer 24 of explosively expanded formation overlying the fragmented mass has low permeability, hence, high pressure drop when gas is introduced. Pressure drop refers to the decrease in pressure as gas flows through the expanded formation. The fragmented mass below the layer 24 has high void fraction and high permeability, hence, has relatively low pressure drop as compared to the overlying transition layer. It is, therefore, important that in vertical in situ retorts such as the exemplary retort 10 of this embodiment, the height of the fragmented mass is several times as high as the overlying expanded layer, preferably at least three times the height of the overlying expanded layer. Almost all of the shale oil recovered is produced in the fragmented mass and the overlying layer is included for bulking the retort full. The layer usually makes a minor contribution to the total shale oil recovered. A major portion of the layer can be bypassed by forming the conduits 40 through the layer to provide a low pressure drop between the gas inlets or conduits and the retort outlet 42.

The number of conduits 40 (or redrilled blastholes 60) and their depth into the body of expanded formation is determined by the pressure drop through the retort. Thus, retort pressure drop is monitored during the drilling of the conduits 40 or redrilling of the blastholes 60 and, when a reasonable pressure drop is obtained, drilling operations are stopped and the retort is prepared for ignition. It is thought that unless the conduits are drilled through the top zone 28 and at least a portion of the middle zone 30 of the layer 24, the pressure drop will be higher than desired.

Burners are placed into one or more of the conduits and hot ignition gas from the burner(s) is directed downwardly through the conduit or conduits for heating the fragmented formation particles at an elevation at about the outlet of the conduit(s). As mentioned above, since the bottom zone 26 of the layer 24 is fragmented to about the same extent as the fragmented permeable mass 22, it is thought that ignition will take place at about the elevation of the bottom zone 26 of the layer 24.

Once a combustion zone is formed substantially across the entire horizontal extent of the retort, the burner or burners can be extinguished and oxygen-supplying gas can be introduced into the retort through the conduits both to sustain the combustion zone and to advance the combustion zone downwardly through the retort. Kerogen is decomposed in a retorting zone on the advancing side of the combustion zone forming liquid and gaseous products which are removed from the bottom of the retort through the outlet 42.

In another exemplary embodiment of practice of principles of this invention, a vertical in situ oil shale retort can be provided with a top boundary that is arched instead of generally horizontal.

Although practice of principles of the invention described above is in terms of vertical retorts, i.e., retorts with one or more inlets at about the top and one or more outlets at about the bottom, it can also be useful for horizontal retorts. For example, when a horizontal retort is formed that is not filled completely to its top, retorting gases can preferably pass through the void space at the top of the retort, thereby bypassing the fragmented mass. Providing a body of explosively expanded formation according to practice of this invention comprising a top layer that fills the retort to its top boundary can prevent such bypassing and enhance retorting operations.

The above description of methods for recovering liquid and gaseous products from a subterranean formation containing oil shale, including the descriptions of formation of a body of expanded oil shale formation in a retort that fills the retort to its top boundary and is capable of supporting overlying unfragmented formation, is for illustrative purposes. Because of variations which will be apparent to those skilled in the art, the present invention is not intended to be limited to the particular embodiments described hereinabove. The scope of the invention is defined in the following claims.

What is claimed is:

1. A method for forming an in situ oil shale retort in a retort site in a subterranean formation containing oil shale, the in situ retort containing a body of expanded oil shale formation and having top, bottom, and generally vertically extending side boundaries of unfragmented formation, the method comprising the steps of:

forming a lower portion of the body of expanded oil shale formation comprising a fragmented permeable mass of formation particles; and thereafter explosively expanding a layer of unfragmented formation downwardly toward the lower portion of the body of expanded formation for forming the remaining portion of the body of expanded formation, the layer having a volume sufficient to provide that the available void fraction for expansion of the layer is no more than about ten percent so that the remaining portion of the body of expanded formation completely fills the retort to its top boundary.

2. The method according to claim 1 wherein the layer of unfragmented formation has a volume sufficient to provide that the available void fraction for expansion of the layer is no more than about five percent.

3. The method according to claim 1 further comprising forming conduits through at least a portion of the explosively expanded layer for introduction of gas to the fragmented permeable mass.

4. The method according to claim 1 wherein the height of the lower portion of the body of expanded oil shale formation is at least three times the height of the remaining portion.

5. The method according to claim 1 wherein the void fraction of the lower portion of the body of expanded oil shale formation is uniformly distributed.

6. A method for forming an in situ oil oil shale retort in a retort site in a subterranean formation containing oil shale, the in situ oil shale retort containing a body of expanded oil shale formation within top, bottom, and generally vertically extending side boundaries of unfragmented formation, the method comprising the steps of:

forming a lower portion of the body of expanded oil shale formation comprising a fragmented permeable mass of formation particles; and thereafter explosively expanding an overlying layer of unfragmented formation toward the fragmented mass for forming the remaining portion of the body of expanded formation, the available void for expansion of the layer being sufficiently small that the expanded layer provides a gradual transition of permeability between a relatively higher permeability adjacent the top of the fragmented permeable mass and a relatively lower permeability adjacent overlying unfragmented formation.

7. The method according to claim 6 wherein the available void for expansion of the layer is such that the remaining portion of the body of expanded formation has an average void fraction of less than about ten percent.

8. The method according to claim 6 wherein the available void for expansion of the layer is such that the remaining portion of the body of expanded formation has an average void fraction of less than about five percent.

9. The method according to claim 6 further comprising forming conduits through at least a portion of the explosively expanded overlying layer for introduction of gas to the fragmented permeable mass.

10. The method according to claim 6 wherein the height of the lower portion of the body of expanded oil shale formation is at least three times the height of the remaining portion.

11. The method according to claim 6 wherein the void fraction of the lower portion of the body of expanded oil shale formation is uniformly distributed.

12. A method for forming an in situ oil shale retort in a retort site in a subterranean formation containing oil shale, the in situ retort containing a body of expanded oil shale formation and having top, bottom, and generally vertically extending side boundaries of unfragmented formation, the method comprising the steps of:

excavating at least one void in the subterranean formation within the retort boundaries, while leaving an upper zone of unfragmented formation adjacent such a void, above the void, and a lower zone of unfragmented formation adjacent such a void, below the void;

explosively expanding unfragmented formation from at least one of the zones of unfragmented formation toward the void to thereby form a first portion of the body of expanded oil shale formation comprising a fragmented permeable mass of formation particles; and thereafter explosively expanding a layer of the upper zone of unfragmented formation downwardly toward the first portion of the body of expanded formation being formed to form the remaining portion of the body of expanded formation, the layer having a volume sufficient to provide that the available void fraction for expansion of the layer is no more than about 10 percent so that the remaining portion of the body of expanded formation completely fills the retort to its top boundary.

13. The method according to claim 12 wherein the layer has a volume sufficient to provide that the available void fraction for expansion of the layer is no more than about 5%.

14. The method according to claim 12 wherein the void is a limited void.

15. The method according to claim 12 wherein all of the explosive expansions are in the same single round.

16. The method according to claim 12 further comprising forming conduits through at least a portion of the explosively expanded layer for introduction of gas to the fragmented permeable mass.

17. The method according to claim 12 wherein the height of the lower portion of the body of expanded oil shale formation is at least three times the height of the remaining portion.

18. The method according to claim 12 wherein the void fraction of the lower portion of the body of expanded oil shale formation is uniformly distributed.

19. A method for forming an in situ oil shale retort in a retort site in a subterranean formation containing oil shale, the in situ retort containing a body of expanded oil shale formation and having top, bottom, and generally vertically extending side boundaries of unfragmented formation, the method comprising the steps of:

forming a lower portion of the body of expanded oil shale formation comprising a fragmented permeable mass of formation particles having an average void fraction of greater than about 15%; and thereafter explosively expanding a layer of unfragmented formation downwardly toward the lower portion of the body of expanded formation for forming the remaining portion of the body of expanded formation having an average void fraction of no more than about ten percent, the height of the fragmented mass being at least three time the height of the layer of unfragmented formation being expanded.

20. The method according to claim 19 further comprising forming conduits through at least a portion of the explosively expanded layer for introduction of gas to the fragmented permeable mass.

21. The method according to claim 19 wherein the void fraction of the fragmented mass is uniformly distributed.

22. The method according to claim 21 wherein the average void fraction of the fragmented mass is greater than 15 percent.

23. A method for forming an in situ oil shale retort in a retort site in a subterranean formation containing oil shale, the in situ retort containing a body of expanded oil shale formation and having top, bottom, and generally vertically extending side boundaries of unfragmented formation, the method comprising the steps of:

excavating at least one void in the subterranean formation within the retort boundaries, while leaving an upper zone of unfragmented formation adjacent such a void, above the void, and a lower zone of unfragmented formation adjacent such a void, below the void;

explosively expanding unfragmented formation from at least one of such zones of unfragmented formation toward the void to thereby form a lower portion of the body of expanded oil shale formation comprising a fragmented permeable mass of formation particles; and thereafter explosively expanding a layer of the upper zone of unfragmented formation downwardly toward the first portion of the body of expanded formation being formed to form the remaining portion of the body of expanded formation, the layer having a volume sufficient to provide that the available void fraction for expansion of the layer is no more than about ten percent so that the remaining portion of the body of expanded formation completely fills the retort to its top boundary.

24. The method according to claim 23 wherein the layer has a volume sufficient to provide that the available void fraction for expansion of the layer is no more than about five percent.

25. The method according to claim 23 wherein the void is a limited void.

26. The method according to claim 23 wherein all of the explosive expansions are in the same single round.

27. The method according to claim 23 further comprising forming conduits through at least a portion of the explosively expanded layer for introduction of gas to the fragmented permeable mass.

28. The method according to claim 23 wherein the void fraction of the lower portion of the body of expanded oil shale formation is uniformly distributed.

29. A method for forming an in situ oil shale retort in a retort site in a subterranean formation containing oil shale, the in situ oil shale retort containing a body of expanded oil shale formation within top, bottom, and generally vertically extending side boundaries of unfragmented formation, the method comprising the steps of:

excavating formation to form at least one limited void in the subterranean formation within the retort boundaries, while leaving an upper zone of unfragmented formation adjacent such a void, above the void, and a lower zone of unfragmented formation adjacent such a void, below the void;

explosively expanding unfragmented formation from at least one of the zones of unfragmented formation toward the void to thereby form a first portion of the body of expanded oil shale formation comprising a fragmented permeable mass of formation particles, while leaving a void space between the upper surface of such a first portion of the body of expanded formation and the bottom surface of a horizontally extending layer of the upper zone of unfragmented formation overlying the void space;

determining the volume of the void space;

forming an array of explosive charges in the overlying, horizontally extending layer of the upper zone of unfragmented formation; and detonating the explosive charges in the overlying layer for explosively expanding the layer downwardly toward the first portion of the body of expanded formation to form the remaining portion of the body of expanded formation, the combination of the volume of the void space and the volume of the overlying layer providing an available void fraction no greater than about ten percent so that the remaining portion of the body of expanded formation substantially completely fills the retort to its top boundary.

30. The method according to claim 29 wherein the explosively expanded layer has a bottom zone comprising fragmented formation particles adjacent the top of the first portion of the body of expanded formation, a top zone of essentially intact formation at the retort top boundary, and a zone between the top and bottom zones comprising fractured formation.

31. The method according to claim 29 wherein the available void fraction for expansion of the overlying, horizontally extending layer of the upper zone of unfragmented formation is no greater than about five percent.

32. The method according to claim 29 wherein the volume of the void space is determined by measurement between rounds of explosive detonations.

33. The method according to claim 29 wherein all of the explosive expansions are in the same single round.

34. The method according to claim 29 further comprising forming conduits through at least a portion of the explosively expanded layer for introduction of gas to the fragmented permeable mass.

35. The method according to claim 29 wherein the height of the first portion of the body of expanded oil shale formation is at least three times the height of the remaining portion.

36. The method according to claim 29 wherein the void fraction of the first portion of the body of expanded oil shale formation is uniformly distributed.

37. An in situ oil shale retort in a subterranean formation containing oil shale, the retort comprising:

a bottom boundary, a generally horizontally extending top boundary, and generally vertically extending side boundaries of unfragmented formation;

a body of explosively expanded oil shale formation contained within the retort boundaries comprising:

a first portion comprising a fragmented permeable mass of formation particles extending from the bottom boundary of the retort to an elevation below the top boundary and having an average void fraction of greater than about 15%; and a remaining portion comprising a layer of expanded oil shale formation extending between the top of the first portion and the top boundary of the retort, the layer provided to support the top boundary for inhibiting formation from sloughing from the top boundary during retorting operations, the average void fraction of the remaining portion being no more than about ten percent.

38. An in situ oil shale retort according to claim 37 wherein the remaining portion of the body of expanded oil shale formation has an average void fraction of less than about five percent.

39. An in situ oil shale retort according to claim 37 wherein the layer comprising the remaining portion of the body of expanded oil shale formation comprises a bottom zone comprising fragmented formation particles adjacent the top of the first portion of the body of expanded oil shale formation, a top zone of essentially intact formation adjacent the retort top boundary, and a zone between the top and bottom zones comprising fractured oil shale formation.

40. An in situ oil shale retort according to claim 37 additionally comprising a plurality of conduits through at least a portion of the layer for introduction of oxygen-supplying gas into the retort.

41. An in situ oil shale retort according to claim 37 wherein the fragmented mass of formation particles has a uniformly distributed void fraction.

42. An in situ oil shale retort according to claim 37 wherein the height of the fragmented mass of formation particles is at least three times the height of the layer of expanded oil shale formation.

43. An in situ oil shale retort in a subterranean formation containing oil shale comprising:

a bottom boundary, a generally horizontally extending top boundary, and generally vertically extending side boundaries of unfragmented formation;

a body of explosively expanded formation within the retort boundaries comprising:

a lower portion comprising a fragmented permeable mass of formation particles extending from the bottom boundary to an elevation below the top boundary; and an upper remaining portion between the fragmented permeable mass and the top boundary, the upper portion having a gradual transition between a relatively higher void fraction adjacent the top of the fragmented mass and a relatively lower void fraction adjacent the top boundary of unfragmented formation.

44. An in situ oil shale retort according to claim 43 wherein the upper remaining portion of the body of explosively expanded formation has an average void fraction of less than about ten percent.

45. An in situ oil shale retort according to claim 43 wherein the upper remaining portion of the body of explosively expanded formation has an average void fraction of less than about five percent.

46. An in situ oil shale retort according to claim 43 additionally comprising a plurality of conduits through at least a portion of the upper remaining portion of the body of explosively expanded formation for introduction of gas into the retort.

47. An in situ oil shale retort in a subterranean formation containing oil shale, the retort comprising:

a bottom boundary, a generally horizontally extending top boundary, and generally vertically extending side boundaries of unfragmented formation;

a body of explosively expanded oil shale formation contained within the retort boundaries comprising:

a first portion comprising a fragmented permeable mass of formation particles having an average void fraction greater than about 15 percent extending from the bottom of the retort to an elevation below the top boundary; and a remaining portion comprising a layer of expanded oil shale formation having an average void fraction of no more than about ten percent extending between the top of the first portion and the top boundary of the retort, the layer provided to support the top boundary for inhibiting formation from sloughing from the top boundary during retorting operations.

48. An in situ oil shale retort according to claim 47 wherein the layer of expanded oil shale formation has an average void fraction of no more than about five percent.

49. An in situ oil shale retort according to claim 47 additionally comprising a plurality of conduits through at least a portion of the layer of expanded formation for introduction of gas into the retort.

50. A method for recovering gaseous and liquid products from an in situ oil shale retort in a retort site in a subterranean formation containing oil shale, the in situ oil shale retort containing a body of expanded oil shale formation and having a top boundary, generally vertically extending side boundaries, and a bottom boundary of unfragmented formation, the method comprising the steps of:

excavating formation to form at least one generally horizontal void in the subterranean formation within the retort boundaries, while leaving within the retort boundaries an upper zone of unfragmented formation having a substantially horizontal free face extending over the void and a lower zone of unfragmented formation having a substantially horizontal free face extending below the void;

forming a generally horizontal array of explosive charges in the lower zone of unfragmented formation;

forming at least two generally horizontal arrays of explosive charges in the upper zone of unfragmented formation, a first lower array being adjacent the horizontally extending free face of the upper zone for explosively expanding a bottom layer of the upper zone toward the void, a second upper array remote from the horizontally extending free face with each charge comprising the second array having a distal end contiguous with the retort top boundary for explosively expanding a top layer of the upper zone toward the void;

in a single round, detonating the first array of explosive charges in the upper zone and the array of explosive charges in the lower zone for expanding the bottom layer of the upper zone and at least a portion of the lower zone toward the void for forming a first portion of the body of expanded oil shale formation comprising a fragmented permeable mass of formation particles; thereafter detonating the second array of explosive charges in the upper zone for expanding the top layer of the upper zone downwardly toward the first portion of the body of expanded formation being formed to form the remaining portion of the body of expanded formation, the top layer of the upper zone having a volume sufficient that the available void fraction for expansion of the layer is no more than about ten percent, the remaining portion of the body of expanded formation completely filling the retort to the retort top boundary;

forming generally vertical boreholes through at least a top portion of the remaining portion of the body of expanded formation for introduction of gas into the retort;

establishing a combustion zone in the body of expanded formation and introducing an oxygen-supplying gas through such boreholes into the retort to sustain the combustion zone and advance the combustion zone downwardly through the body of expanded formation in the retort, liquid and gaseous products being produced in a retorting zone on the advancing side of the combustion zone; and withdrawing liquid and gaseous products from the retort.

51. The method according to claim 50 comprising detonating the second array of explosive charges in the same single round with the first array of charges in the upper zone and the array of charges in the lower zone.

52. The method according to claim 50 wherein the void excavated in the subterranean formation is a limited void.

53. The method according to claim 50 wherein each such array of explosive charges has an equivalent point charge scaled depth of burial from about 6 to about 12 mm/cal$^{\frac{1}{3}}$.

54. A method for forming an in situ oil shale retort in a subterranean formation containing oil shale, the in situ retort containing a body of expanded oil shale formation and having top, bottom, and generally vertically extending side boundaries of unfragmented formation, the method comprising the steps of:

excavating a void in the subterranean formation within the retort boundaries while leaving a zone of unfragmented formation adjacent such a void above the void;

explosively expanding the zone of unfragmented formation downwardly toward the void in at least two vertically spaced layers, each of which extends horizontally across the retort between the retort side boundaries, by the steps of:

explosively expanding the layer nearer the void downwardly toward the void to form a first portion of the body of expanded oil shale formation comprising a fragmented permeable mass of formation particles; and thereafter explosively expanding the layer most remote from the void downwardly toward the first portion of the body of expanded formation being formed to provide the remaining portion of the body of expanded formation, the void fraction available for expansion of the remote layer being no more than about ten percent so that the remaining portion of the body of expanded formation completely fills the retort to its top boundary.

55. The method according to claim 54 wherein the void fraction available for expansion of the remote layer is no more than about five percent.

56. The method according to claim 54 wherein the void is a limited void.

57. The method according to claim 54 wherein all such layers of the zone of unfragmented formation over the void are explosively expanded toward the void in the same single round.

* * * * *